United States Patent [19]

Tajima et al.

[11] Patent Number: 4,669,852

[45] Date of Patent: Jun. 2, 1987

[54] DEVELOPING APPARATUS

[75] Inventors: Hatsuo Tajima, Matsudo; Kimio Nakahata, Kawasaki; Hidemi Egami, Zama; Fumitaka Kan; Atsushi Hosoi, both of Tokyo, all of Japan

[73] Assignee: Canon Kabushiki Kaisha, Tokyo, Japan

[21] Appl. No.: 652,570

[22] Filed: Sep. 20, 1984

[30] Foreign Application Priority Data

Sep. 27, 1983 [JP] Japan ..... 58-178614
Sep. 10, 1984 [JP] Japan ..... 59-189058

[51] Int. Cl.[4] ..... G03G 15/08
[52] U.S. Cl. ..... 355/3 DD; 118/653
[58] Field of Search ..... 355/3 DD, 14 D; 118/653, 657, 658; 430/101, 120

[56] References Cited

U.S. PATENT DOCUMENTS 4,406,535 9/1983 Sakamoto et al. .
4,548,489 12/1985 Yoshikawa .
4,559,899 12/1985 Kan et al. .
4,563,978 1/1986 Nakamura et al. .
4,571,372 2/1986 Urawa .

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

A developing apparatus for developing a latent image on a latent image bearing member, including a magnetic device for forming a magnetic brush of a developer mixture containing developer particles and magnetic particles; a movable developer carrying member for developing the latent image on the latent image bearing member, the developer carrying member being contactable with the magnetic brush to receive the developer mixture; a magnetic particle blocking member, disposed opposed to the developer carrying member at a position downstream of the position where the developer carrying member is contacted with the magnetic brush, for blocking the magnetic particles to form a coating of the developer particles on a surface of the developer carrying member, wherein the coating of the developer particles is conveyed by the movement of the developer carrying member to a developing station where the latent image is developed with the conveyed developer particles.

45 Claims, 6 Drawing Figures

DEVELOPING APPARATUS

BACKGROUND OF THE INVENTION

The present invention relates to a developing apparatus, more particularly, to a developing apparatus for an image forming apparatus, such as an electrophotographic copying apparatus, wherein a latent image to be developed is formed on a latent image bearing member, such as a photosensitive member.

Various types of developing methods used with one component developer are known, such as a powder cloud method wherein the cloud is generated by blowing toner powder, a contact method wherein a uniform toner layer formed on a developer carrying member in the form of a web, sheet or roller is directly contacted to a latent image bearing member surface to develop the same, a jumping method wherein a layer of toner particles are not directly contacted to a latent image bearing member surface, but image-wisely transferred to the latent image bearing member surface with the aid of the electric field generated by the latent image, and a so-called magne-dry method wherein a magnetic brush of conductive and magnetic toner particles are contacted to a latent image bearing member surface.

Among such developing methods, the jumping method is known as a peculiar method. In this method, the developing particles are applied on a developer carrying member as a thin layer, whereafter the thin layer of the developer is brought to be opposed to an electrostatic latent image bearing surface with a small gap between the surface of the thin layer of the developer and the latent image bearing surface. Then, the developer particles of the thin layer jump to the latent image bearing surface from the developer carrying member by virtue of the electrostatic force (U.S. Pat. Nos. 2,839,400 and 3,232,190). In this method, the developing operation is performed without a foggy background, since the non-image area of the latent image bearing surface where there is no latent image potential does not attract the developer particles, and in addition, it is not contacted by the developer particles.

However, since the developing operation is based on the jumping action of the toner particles caused by the electric field of the electrostatic image, the developed image is not sharp at an edge of the image, and a line image seems to be thinner than the original. Additionally, the curve of the density of the developed image v.s. the potential of the electrostatic latent image is steep, so that the half-tone reproduction is not good.

A new developing method has been proposed, for example, in U.S. Pat. Nos. 4,356,245, 4,292,387 and 4,395,476, which have been assigned to the assignee of this application, whereby the problems of sharpness and toner reproducibility involved in the conventional jumping developing method have been solved.

Among the three U.S. patents, the first one discloses a method wherein a uniform thin developer layer of one component developer is formed on a developer carrying member and is opposed to a surface of an electrostatic latent image bearing member with a small gap between the surface of the thin developer layer and the surface of the latent image bearing member. The developer is expanded by the electrostatic attracting force by the latent image in the image area to develop the latent image. According to this method, wherein the developer particles do not contact the latent image bearing member in the non-image area, the developed image is sharp and without a foggy background.

In the last two U.S. patents, a thin layer of developer is formed and opposed to the latent image bearing member in the similar manner as above, but an alternating bias voltage as a developing bias voltage is applied between the developer carrying member and the latent image bearing member to produce a reciprocating action of the developer particles, and the clearance or gap between the latent image bearing member surface and the developer carrying member is changed with time, thereby developing the latent image. In the first part of the developing action, the developer particles are transferred to the latent image bearing member in the image area and also in the non-image area so that the half-tone part is developed. With elapse of time, the developer reaches only the image area of the latent image bearing member. According to this method, the resultant image is sharp and without a foggy background, and the toner reproducibility is good.

In these types of developing methods, it is important to form a uniform and thin layer of developer on a developer carrying member. In the case where the developer is a one component magnetic developer, the formation of the thin layer is relatively easy to practice, since the developer is relatively easily controlled by magnetic means. However, in the case where one component non-magnetic developer is used, it is difficult to obtain satisfactory results at all times.

In the conventional developing methods, it is usual that the one component non-magnetic developer particles (toner particles) are supplied to a developer carrying member, such as a developing roller, and electrically charged by a frictional charging member, whereafter they are brought to be opposed to the electrostatic latent image bearing surface. However, if the toner particles supplied to the developing roller are not constant, the toner layer formed on the developer carrying member can be non-uniform. Furthermore, the toner particles can be worn by the friction with the frictional charging member and/or the developing roller so that they are fused and coagulated on the frictional charging member and/or the developing roller surface. This makes the toner layer formation and the electric charge of the toner particles non-uniform. These appear as non-uniform development on the resultant image.

If the surface of the developing roller is roughened with the view to better retention of the toner particle layer thereon, or if a number of small perforations are formed on the surface of the toner particle carrying member with the same view, the toner particles caught by the recesses or the perforations are not easily charged by the charging means, and therefore, do not contribute to the developing operation, so that the resultant image is not good with insufficient image density.

It has further been proposed, in U.S. Pat. No. 4,383,497 that a magnetic brush comprising a developer (toner) and magnetic particles (carrier) is formed on a magnetic roller, and then brought into contact with a developing roller so that only the toner is transferred onto the developing roller and used in the developing action. However, it is difficult to completely block the deposition of the carrier particles onto the developing roller. If the carrier particles deposited on the developing roller are brought to the developing station, the developing bias can leak through the carrier particles between the developing roller and the photosensitive member, and the carrier particles can be transferred to the surface of the photosensitive member, which can damage the surface thereof.

SUMMARY OF THE INVENTION

Accordingly, it is a principal object of the present invention to provide an improved developing apparatus.

It is another object of the present invention to provide a developing apparatus wherein magnetic particles are confined within the developing apparatus, and only the developer particles are applied on the developer carrying member.

It is a further object of the present invention to provide a developing apparatus whereby a good developing operation can be performed with one component non-magnetic developer.

It is a further object of the present invention to provide a developing apparatus which can be used for color image formation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings.

Figure 1:
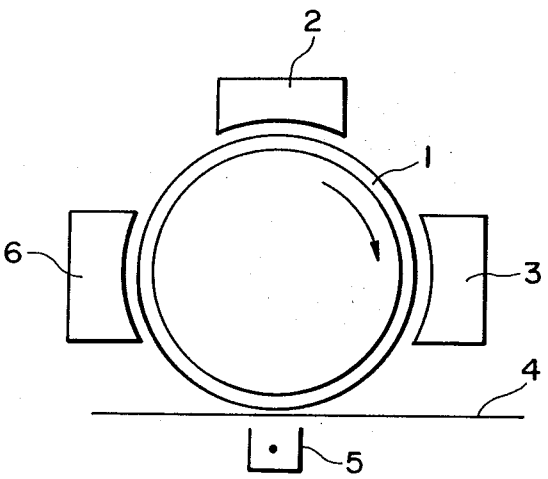
FIG. 1 schematically shows an image forming apparatus which is usable with a developing apparatus according to the present invention.

Referring now to FIG. 1, there is shown an image forming apparatus usable with a developing apparatus according to the present invention. The image forming apparatus comprises an electrostatic latent image bearing member 1 having a photoconductive layer, an electrostatic latent image forming device 2 including charging means and image exposure means, a developing device 3 according to the present invention, an image transferring device 5 for transferring the developed image to a transfer material 4 and a cleaning device 6 for cleaning the electrostatic latent image bearing member.

Figure 2:
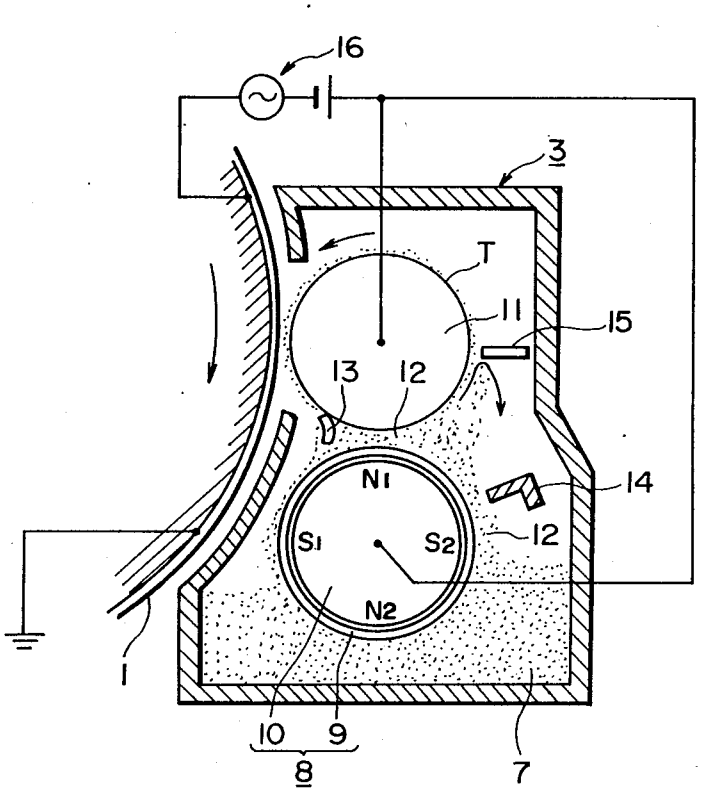
FIG. 2 is a cross-sectional view of a developing apparatus according to an embodiment of the present invention.

FIG. 2 shows the developing device according to the first embodiment of the present invention. The developing device 3 contains the developer 7 consisting of one component non-magnetic toner particles T and the magnetic particles. The developing device 3 includes a magnetic roller 8, as magnetic means, which comprises a sleeve 9 of a non-magnetic material and a magnet 10. The developing device 3 further includes a developing roller 11 as a developer carrying means and a scraper 13. Designated by reference numeral 12 is a magnetic brush. In order to regulate the amount of the developer on the magnetic roller 8, a regulating member 14 is provided. A magnetic particle blocking or confining member 15 is provided in the region to which the magnetic field formed by the magnetic pole N1 of the magnet 10 extends, so as to be opposed to the developing roller 11. The developing device 3 further includes a developing bias source 16.

As described above, the magnetic roller 8 comprises the non-magnetic sleeve 9 which is rotatable, and the magnet 10 fixed within the sleeve 9. The magnetic roller 8 is effective to form the magnetic brush 12 consisting of the non-magnetic toner particles T and magnetic particles and effective to convey the toner particles and magnetic particles. The magnet 10 which is fixed within the non-magnetic sleeve 9, is provided with the single magnetic pole Nl at a position opposed to the developing roller 11 and further provided with conveying magnetic poles S1, N2 and S2 at the other positions, as shown in FIG. 2. The developing roller 11 is made of iron in this embodiment.

The magnetic field produced by the magnetic roller 8 establishes a magnetic circuit via the developing roller 11 and the magnetic particle blocking member 15. Therefore, the magnetic brush 12 formed on the magnetic roller 8 is attracted toward the developing roll 11, whereby a part of the magnetic brush 12 is transferred from the magnetic roller 8 to the developing roller 11.

The non-magnetic toner particles and the magnetic particles thus deposited on the developing roller 11 are separated by the magnetic particle blocking member 15 so that only the non-magnetic toner particles T are on the developing roller 11 at the downstream side of the developer particle blocking member 15, while the magnetic particles are confined in the region upstream of the magnetic particle blocking member 15 by the magnetic circuit described above. The magnetic particles blocked by the magnetic particle blocking member 15 fall toward the bottom of the developing device or toward the magnetic roller 8 and circulate.

Figure 3:
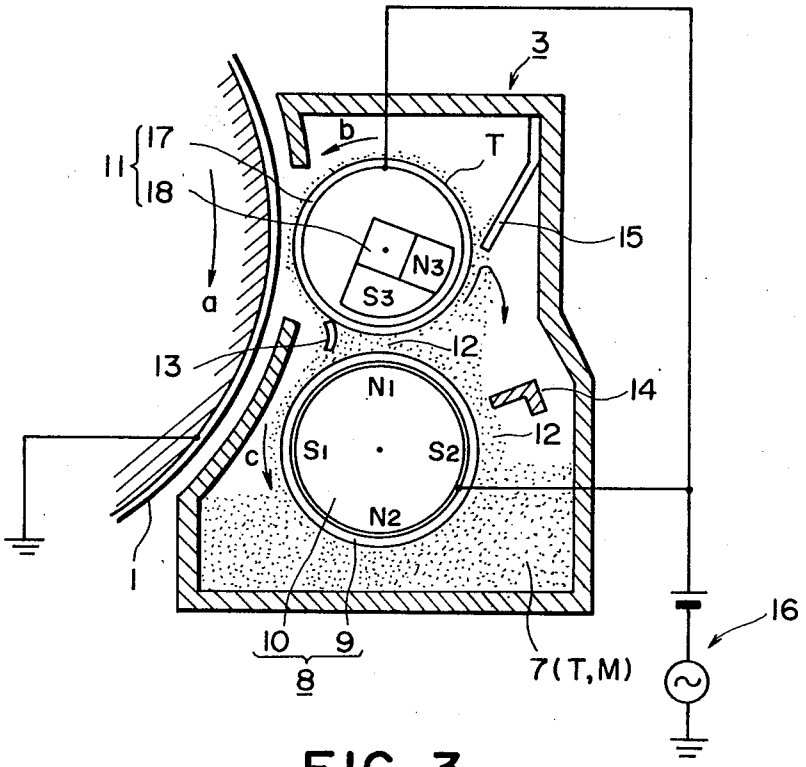
FIGS. 3 and 4 are cross-sectional views of developing apparatuses according to other embodiments of the present invention.

Within the developing roller 11, a magnet may be provided. This can promote the function of receiving, from the magnetic roller 8 to the developing roller 11, the toner particles and the magnetic particles, and to promote the stirring action of the toner and magnetic particles in the area where the two rollers are opposed. Further, if a magnetic circuit is formed between the magnet in the developing roller 11 and the magnetic particle blocking member 15, the magnetic particles are further blocked by the magnetic force so that a remarkable result is provided for the purpose of applying only the toner particles T on the developing roller 11. An embodiment of this type will be described in detail. FIG. 3 shows a developing device 3 according to another embodiment. The developing device 3 contains a developer mixture 7 including non-magnetic toner particles T and magnetic particles M. The toner is a one component non-magnetic toner. The developing device 3 includes a magnetic roller 8 as magnetic means, including a rotatable non-magnetic sleeve 9 and a fixed magnet 10. It is a possible alternative that the sleeve 9 is fixed, while the magnet 10 is rotated, or that both are rotated. The developing device 3 further includes a developing roller 11, as the developer carrying means, which includes a developing sleeve 17 rotatable in the direction of arrow b and a fixed magnet 18 therein. Designated by reference numeral 12 is a magnetic brush formed on the magnetic roller 8. The developing device 3 further includes a scraper 13, a regulating member 14 for regulating the amount of the developer on the magnetic roller 8, and a magnetic particle blocking member 15. The magnetic particle blocking member 15 is made of a magnetic material, such as a magnet, iron and permalloy, and located in the region to which the magnetic field of the magnetic pole N3 of the magnet 18 extends and at a position downstream of the magnetic pole N3 with respect to the movement of the sleeve 17. The magnetic particle blocking member 15 is opposed to the developing roller 11 and inclined toward the downstream side with respect to the movement of the sleeve 17. The developing device 3 is provided with a developing bias source 16. In respect of the other elements in this embodiments, a detailed explanation is omitted by assigning the same reference numerals as with FIG. 2 embodiment to the elements having the corresponding functions. In this developing device 3, the non-magnetic toner T was used which had a particle size of 7–15 microns and which contained as the main components 10 parts of carbon and 90 parts of polystyrene, and such particles were mixed with a charge controlling agent, such as colloidal silica. As for the magnetic particles, iron particles were used. The iron particles may be subjected to surface treating of oxidation or may be coated with a resin.

As described above, the magnetic roller 8 includes a rotatable sleeve 9 of a non-magnetic material and a magnet 10 fixed in the sleeve 9. On the magnetic roller 8, a magnetic brush is formed by the developer mixture containing the non-magnetic toner particles T and the magnetic particles M. The magnetic roller 8 conveys the toner particles T and magnetic particles M to the position where it is opposed to the developing roller 11. The magnet 10 fixed in the rotatable non-magnetic sleeve 9 has, as shown in FIG. 3, a single magnetic pole N1 at a position where it is opposed to the developing roller 11, and has conveying magnetic poles S1, N2 and S2 at the other positions.

In this embodiment, the four magnetic poles are positioned equally circumferentially spaced, and the N pole and S pole are distributed alternately, as shown in this Figure. Each of the magnetic poles is such that it provides approximately 400 Gauss of the surface magnetic flux density on the surface of the sleeve 9. The arrangement and the magnetic flux density of the magnetic poles described above are not limiting, but may be 2, 6 or 8 poles equally circumferentially spaced. Furthermore, those poles are not necessarily equally circumferentially spaced. For example, instead of the magnetic pole N1 opposed to the developing roller 11, a repelling magnetic pole may be formed in order to promote the transfer of the developer mixture to the developing roller 11. The clearance or gap between the developing roller 11 and the magnetic roller 8 is preferably be 0.5–10 mm. In this embodiment, this was 4 mm.

If the developing roller 11 is contacted at the developing position to the electrostatic latent image bearing member 1 which rotates in the direction shown by the arrow a, it is preferable that the surface of the sleeve 17 is of a flexible material, such as a rubber. In this embodiment, however, the toner particle layer on the sleeve 17 is kept out of contact with the electrostatic latent image bearing member 1 at the developing position, so that it is not necessary to use as the sleeve 17 a rubber or the like, but a non-magnetic material, such as aluminum or stainless steel, may be used. It is not necessary that the relative speed between the developing roller 11 and the electrostatic latent image bearing member 1 is 0, but they may be rotated in the same direction or opposite directions with a certain relative speed therebetween. In this embodiment, they are rotated in the same peripheral direction such that the peripheral speed of the sleeve 17 is approximately the same as, or 1–1.6 times of, the peripheral speed of the latent image bearing member 1.

Figure 4:
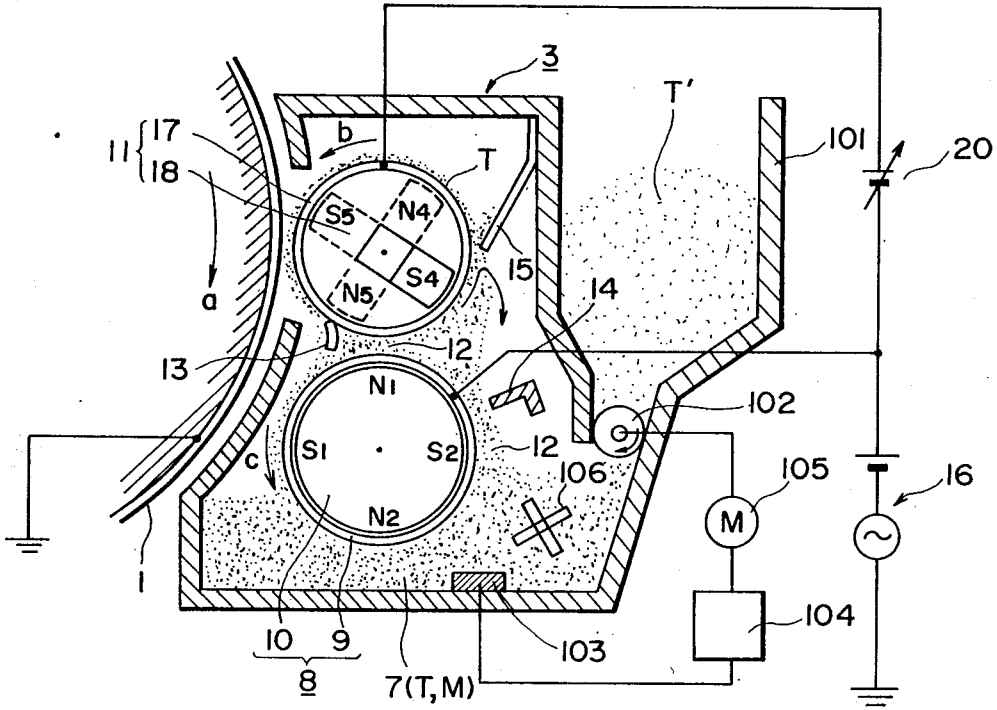

The toner particles T and the magnetic particles M conveyed by the magnetic roller 8, form a magnetic brush 12 erected from the surface of the magnetic roller 8 by the magnetic field of the magnetic pole N1, at a position where the magnetic roller 8 is closely opposed to the developing roller 11. The magnetic brush 12 is attracted to the developing roller 11 by the magnetic pole S3 of the magnet 18, so that a part of the magnetic brush 12 is transferred from the magnetic roller 8 to the developing roller 11. At this position, the strength of the magnetic field provided by the magnetic poles S3 and N1 is preferably such that S3 is larger than Nl. The magnetic pole S3 may be omitted, and the magnetic brush is transferred by the magnetic pole N3 only. In such a case, it is preferable, as shown in FIG. 4 as a further embodiment, that the magnet 18 is provided with a magnetic pole S4 which is opposite in polarity to that of the magnetic pole N1 of the magnetic roller 8.

The magnetic roller 8 may be rotated in the same direction or the opposite direction with respect to the developing roller 11. The peripheral speeds thereof are not necessarily the same, but may be made variable in accordance with the amount of the toner particles and magnetic particles to be received by the developing roller 11. In this embodiment, the sleeve 9 of the magnetic roller 8 is rotated in the opposite peripheral direction to that of the sleeve 17.

The magnetic particles deposited on the developing roller 11 are blocked by the cooperation between the magnetic pole N3 and the magnetic particle blocking member 15. Therefore, only non-magnetic toner particles T are deposited on the surface of the developing roller 11 downstream of the magnetic particle blocking member 15, while the magnetic particles M are confined at the upstream side of the magnetic particle blocking member 15 and fall onto the magnetic roller 8 or toward the bottom of the developing device 3, and circulate. As described above, the toner particles T and the magnetic particles M are transferred to the developing roller 11 by the contact between the magnetic brush 12 and the developing roller 11 surface, whereafter, when they reach the magnetic particle blocking member 15 disposed in opposition to the developing roller 11, the magnetic particles M are confined at the upstream side of the magnetic particle blocking member 15 with respect to the movement of the sleeve 17, so that a thin layer containing the toner particles T only, which layer is preferable for the development, is formed on the developing roller 11. The toner particles in the toner layer formed on the developing roller 11 is electrically charged to a predetermined polarity by the friction with the developing roller 11 surface or with the magnetic particles M, so that they are deposited on the surface of the developing roller 11 by the image force.

In FIG. 3, an AC voltage superposed with a DC is applied to the sleeve 17 of the developing roller 11 by the bias source 16, whereby an alternating electric field is formed between the sleeve 17 and the photosensitive member 1 which is the electrostatic latent image bearing member. The developing roller 11 and the magnetic roller 8 are maintained at the same potential. Between the developing roller 11 and the magnetic roller 8, an electric field for promoting the toner transferring action may be formed by the power source 20, as shown in FIG. 4. If the toner particles are negatively charged, the power source 20 applies a bias voltage of positive polarity to the sleeve 17, as shown. Then, the content of the toner particles in the mixture transferred to the developing roller 11 is higher than that of the developer mixture on the magnetic roller 8. This makes easier the toner layer formation on the developing roller 11. The power source, that is, the electric bias means 20 may be made variable so that the amount of the toner particles moved from the magnetic roller 8 to the developing roller 11 can be controlled. It is preferable that the electrical insulation is enhanced by providing an insulating layer on one of the surfaces of the sleeve 9 or sleeve 17, since then sufficient strength of the electric field can be accomplished between the developing roller 11 and the magnetic roller 8.

Figure 5:
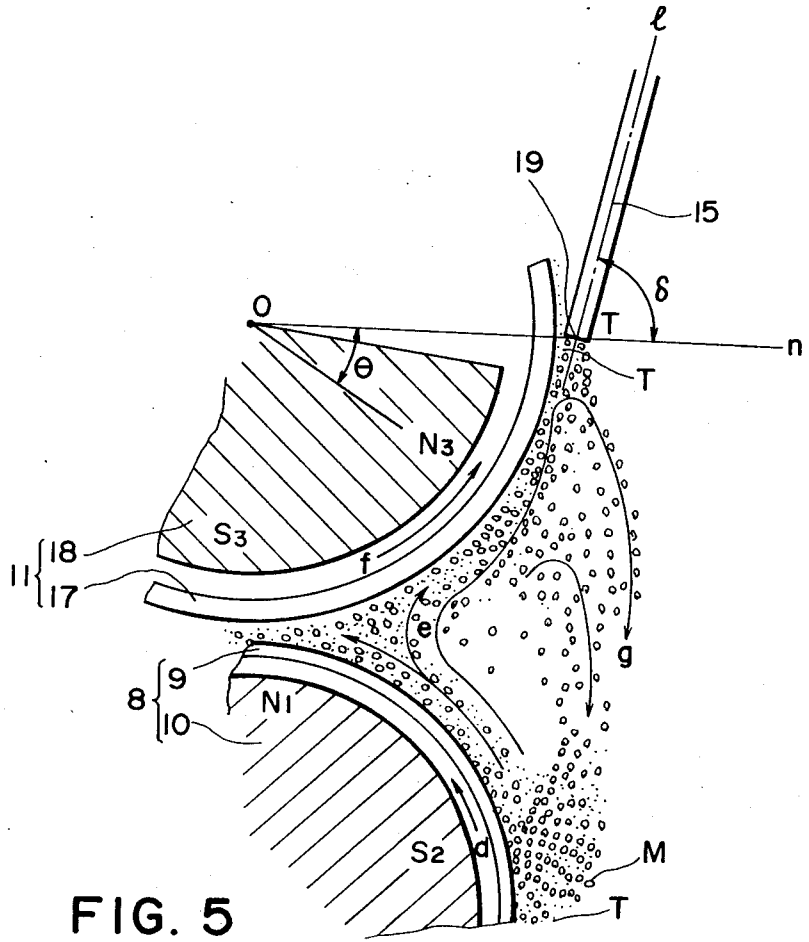
FIG. 5 is an enlarged view of a part of FIG. 3.

As described above, in the present invention, the magnetic particles M are blocked or confined by the magnetic particle blocking member 15 and are circulated between the developing roller 11 and the magnetic roller 8, whereby a thin layer of non-magnetic toner particles only, is formed on the developing roller 11. In order to make these operations stable, there are 3 preferable conditions, which will be described in detail in conjunction with FIG. 5 which is an enlarged view of a part of the structure shown in FIG. 3. In order to effectively and stably confine the magnetic particles by the magnetic particle blocking member 15 and circulate the magnetic particles, the blocking member 15 is made of a magnetic material. In this embodiment, the blocking member 15 is a magnetic blade made of iron and bent as shown in FIG. 3, and mounted on the inner side of the wall of the developing device 3. The magnetic blade 15 is inclined at an angle $\delta$ with respect to a normal line n passing through the center 0 of the sleeve 17 and the intersection 19 between the end surface of the blade 15 the axial line L thereof. The inclination is toward the downstream side with respect to the movement of the sleeve 17. The angle $\delta$ is preferably not less than 0 degree but not more than 90 degrees. If it is less than 0 degree, the magnetic particles tend to leak through the clearance between the sleeve 17 surface and the end of the blade 15, whereas, if it is larger than 90 degrees the blade 15 can contact the surface of the sleeve 17. In this embodiment, the angle $\delta$ was 85 degrees. It is preferable that the blade 15 is so inclined as to be co-directional with the direction of the magnetic field vector of the magnetic pole N3. The tangential component of the magnetic field by the magnetic pole N3 becomes larger than the radial component thereof as the angle approaches 90 degrees, so that the magnetic particles are more effectively confined. This is because the radial component of the magnetic field functions to push the magnetic particles to the surface of the sleeve 17. The clearance between the blade 15 and the sleeve 17 is preferably 100–1000 microns, more preferably 200–300 microns. In this embodiment, the clearance was set to be 200 microns. An angle formed between the normal line n and the magnetic pole N3 is preferably not less than 20 degrees, more preferably not less than 30 degrees, under the condition that the magnetic field provided by the magnetic pole N3 extends to the blade 15. In this embodiment, the angle $\theta$ was set to 30 degrees. When the magnetic blade 15 and the magnetic pole N3 of the magnet 18 are so positioned as described above, the state of the developer mixture at the magnetic blade 15 is as shown in FIG. 5. More particularly, the toner particles T and the magnetic particles M conveyed in the direction of the arrow d are partly transferred in the direction shown by an arrow e at the position where they are contacted to the developing roller 11. The developer mixture thus transferred is conveyed in the direction shown by an arrow f on the sleeve 17 by the rotation thereof in the direction shown by the arrow d.

The magnetic particles M are blocked by the magnetic blade 15 so that the magnetic particles become rich at the upstream side of the magnetic blade 15, and therefore, released from the magnetic confinement, thus falling in the direction shown by an arrow g together with excess non-magnetic toner particles. The conditions for confining the magnetic particles M by the magnetic blade 15 will further be described. The blocking or confining force increases with the increase of the amount of change of the magnetic field at the position of the blade, and also increases with the decrease of the clearance between the magnetic blade 15 and the surface of the developing roller 11. On the other hand, the toner particles T and the magnetic particles M are more strongly conveyed on the surface of the developing roller 11 as the surface roughness of the developing roller 11 increases, and also as the image electric force with respect to the developing roller 11 increases.

As for the magnetic blade 15, the end thereof is preferably located below the horizontal line passing through the center of the developing roller 11, since then the force of gravity is applied to the magnetic particles M in the direction opposite to the conveying force by the movement of the sleeve 17, with the result that the confinement of the magnetic particles M are increased, and therefore the magnetic particles M are more easily fallen in the direction of the arrow g. This makes easier the separation between the toner particles T and the magnetic particles M at the blade 15 position. In other words, a relatively weaker magnetic pole N3 of the magnet 18 may be used without resulting in the magnetic particles M leaking toward the downstream of the blade 15 with respect to the movement of the sleeve 17. In this embodiment, the magnetic flux density of the magnetic pole N3 measured on the sleeve 17 was 500 Gauss without the blade 15.

In order to dispose the magnetic blade 15 in the manner described above, the magnetic roller 8 is preferably positioned below the developing roller 11. In this embodiment, this is satisfied. This arrangement is advantageous in another respect, that is, since the force of gravity is applied to the magnetic particles on the developing roller 11 in the direction opposite to the magnetic confining force, the pressure to the developing roller 11 is decreased, thereby preventing the possible deterioration of the toner particles T and magnetic particles M and the wearing, of the surface of the developing roller 11. Additionally, if it is necessary to provide a plurality of the developing devices 3 around the photosensitive drum 1 as in the case of multi-color electrophotographic copying apparatus, the positioning of the plural developing devices is easy when the magnetic roller 8 is disposed below the developing roller 11. If there is a enough space, the magnetic roller 8 can be disposed above or to the side of, the developing roller 11.

The surface of the sleeve 17 of the developing roller 11 may be subjected to mirror grinding. However, it is preferable that the surface thereof is rough from the standpoint of sufficient coating of the toner particles on the sleeve 17 surface to provide a satisfactory development. It has been confirmed by experiment that, when the surface roughness of the sleeve 17, defined by the 10 point average roughness Rz (JIS) is 0.2–8 microns, the magnetic particles are sufficiently blocked by the magnetic particle blocking member 15 if the clearance between the sleeve 17 surface and the magnetic particle blocking member 15 is not more than approx. 20 times the average particle size of the magnetic particles. It is desirable that the magnetic particles have an average particle size which is 1–30 times of the average particle size of the toner particles, more particularly, it is 30–200 microns, preferably 70–150 microns of the particle size. If the particle size of the magnetic particles is too much smaller than that of the toner particles, there is a tendency that the toner particles and magnetic particles are attached together and applied on the developing roller 11 beyond the magnetic particle blocking member 15. If, on the other hand, the magnetic particles are too large as compared with the toner particles, there is a tendency that the amount of toner particles is decreased so that the stirring of the toner particles and the magnetic particles is not sufficient, and that the toner coating can have stripes. As for the magnetic particles, the carrier particles which are used in the conventional two component developing methods, such as iron particles and ferrite particles, may be used. The developer mixture contains approx. 2–70% by weight of the non-magnetic toner particles with respect to the magnetic particles, more preferably from the standpoint of maintaining the flowability of the developer mixture, 2–20% by weight to the magnetic particles.

In order to maintain a constant content of the toner particles in the developer mixture, a hopper 101 containing the toner particles T′ for supply may be provided as shown in FIG. 4. The toner particles T′ are supplied to the developing device 3 by a supplying roller 102 made of, for example, a sponge. Further, a sensor 103 may be provided within the developing device 3 to detect the toner content therein, and the supply roller 102 may be rotated by driving means 105, such as a motor, to supply the toner particles T′, the driving means 105 being controlled by control means 104 which is responsive to the signal produced by the sensor 103. The sensor 103 may be of an optical detection type, a magnetic detection type, a registance detection type or a dielectric constant detection type, which are known. A stirring member, such as a screw, may be provided to make uniform the developer mixture in the direction of the length of the sleeve 9. Also, magnetic particle conveying poles N4, S5 and N5 may be provided in order to collect the slight amount of magnetic particles which have been leaked through the clearance between the magnetic blade 15 and the surface of the sleeve 17 (the magnetic particles can leak, particularly when the sleeve 17 is rotated at a high speed). The same things apply to the embodiment of FIG. 3.

In the foregoing embodiments, the developer has been described as non-magnetic toner, but magnetic toner containing magnetic material is usable with this invention, if the content of the magnetic material is small enough, or if the particle size is small enough as compared with the magnetic particle, since then the magnetic confining force thereto is weak.

In FIGS. 2 and 3, an AC bias voltage is applied between the developing roller 11 and the latent image bearing member 1 at the developing position to reciprocate the toner particles therebetween. The frequency of the AC bias is determined in accordance with the speed of development. In the field of commercial copying machines, it is as low as several tens Hz without occurrence of non-uniform development. The waveform of the AC voltage may be in the form of a rectangular wave or a triangular wave as well as a sine wave. Also, it is not necessarily symmetric. With such an AC bias applied, the toner particles are deposited on the non-image area, with the result of a foggy background. To avoid this, a DC voltage which is higher than the potential of the non-image area is preferably superposed with the AC bias. In an actual example of this embodiment, the developing roller 11 was opposed to the latent image bearing member 1, which rotated at the peripheral speed of 120 mm/sec, were rotated in the same peripheral direction and at the same speed. The developing roller 11 was spaced from the latent image bearing member 1 by the gap of 300 microns and also spaced from the magnetic particle blocking member 15 with the clearance of 200 microns. A toner layer having 80 microns thickness was formed on the developing roller 11. As for the AC voltage, a DC component 250 V was superposed to an AC voltage of 1300 peak-to-peak voltage and 1600 Hz. When this alternating bias voltage was applied to the sleeve 17 by the power source 16, an image having good tone reproducibility was obtained without a foggy background.

As regards the relation between the image density and the thickness of the toner layer with respect to the ordinarily used toner particles which have approx. 4–20 microns average particle size, the image density of the developed image is significantly influenced by the variation in the thickness of the toner layer in the region of the toner layer thickness upto 30 microns, whereas the image density saturates in the region of 30 microns or larger. It follows that the toner layer having the thickness not more than 30 microns which leads to unstabilized image density, requires to control the toner layer with the view to providing a uniform distribution. However, with the toner particles whose average particle size is not less than 30 microns, a satisfactory image density is obtained without difficulty, so that it is desirable.

In the region of 100 microns or larger of the thickness of the toner layer, the saturation has almost been reached, so that there is no problem of the image density. Therefore, in order to adjust the clearance with the image bearing member surface, any of the toner layer thickness in this range can be used. However, the increase of the toner layer thickness results in an increased amount of the toner particles to be supplied, and therefore, the range not more than 100 microns is preferable from the standpoint of economy and easy operation.

The surface of the developing roller 11, after the developing operation, is scraped by the scraper 13 so that the remaining toner particles are removed therefrom. This is not necessary but it is preferable because, by removing the toner particles from the developing roller 11 after development, the next toner application by the magnetic brush is made satisfactorily uniform, in addition, the possible occurrence of ghost images, avoided which is an image appearing on the next image by the toner particles remained on the developing roller 11 can be completely avoided. The scraper 13 may preferably be a metal sheet, such as phosphor bronze of 0.1–0.2 mm thickness, or a rubber plate, such as polyurethane rubber of rubber hardness, 60–90 degrees.

Figure 6:
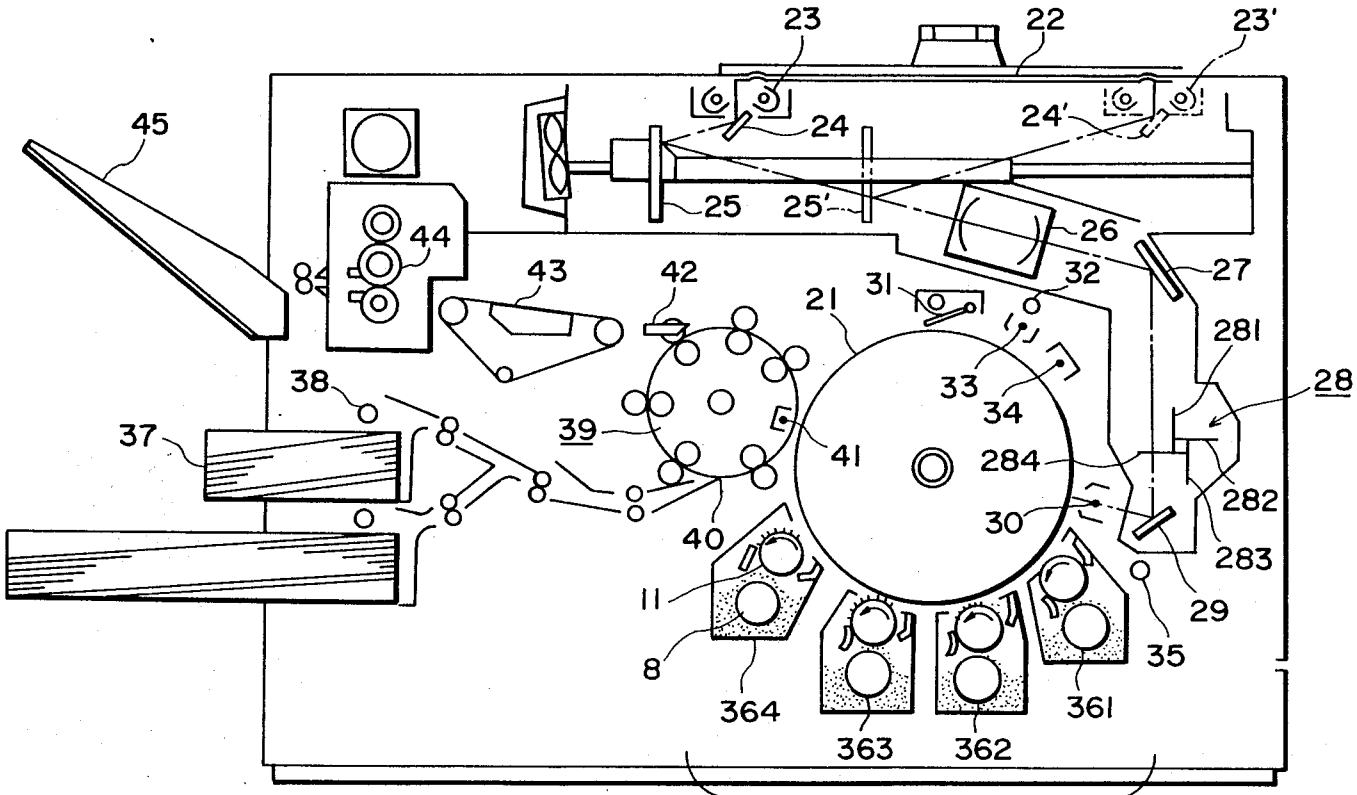
FIG. 6 is a cross-sectional view of a multi-color image forming apparatus using the developing apparatus according to the present invention.

FIG. 6 shows a color image forming apparatus using the developing device of the present invention.

A photosensitive drum 21 comprises as main components a conductive layer, a photoconductive layer and an insulating surface layer. The image formation apparatus includes an original supporting glass 22 on which an original to be copied is placed and an illuminating lamp 23. The original scanned by scanning mirrors 24 and 25 which are driven in synchronism with the rotation of the drum 21. The scanning mirrors 24 and 25 are moved to the positions shown by the reference numerals 24' and 25'. During this movement, the illumination lamp 23 also moves upto the position shown by the reference numeral 23'

A light image of the original being scanned is projected onto the surface of the photosensitive drum 21 through the lens 26, mirror 27, color separating means 28, mirror 29 and a discharger 30 for the simultaneous image exposure and charge removal. The color separating means 28 includes a blue filter 81, a green filter 282, a red filter 283 and ND filter 284, which are selectively moved into the optical path.

The surface of the photosensitive drum 21 is previously cleaned by a blade cleaner 31 and subjected to the operations of the pre-exposure lamp 32 and pre- charge-remover 33 to be free from the influence of the previous latent image. Then, the surface of the photosensitive drum is uniformly charged by a primary charger 34, whereafter it is exposed to the light image and simultaneously subjected to the charge removing operation by the charge remover 30. Then, the surface of the photosensitive drum is uniformly exposed to light by the whole surface exposure lamp 35, with the result of formation of a high contrast electrostatic latent image on the surface of the photosensitive drum. Then, the latent image is developed by one or more units of the developing device 36 consisting of plural developing units, i.e., yellow developing unit 361, magenta developing unit 362, cyan developing unit 363 and black developing unit 364 for developing with non-magnetic toner particles of respective colors. For each of those developing units 361–364, a developing device 3 as explained with respect to FIGS. 2–4 is used. Each of the developing units includes the developing roller 11 and the magnetic roller 8.

A transfer material onto which the developed image is to be transferred, is fed to the image transfer unit 39 by the feeding roller 38. The image transfer unit 39 includes a gripper 40, which grips the leading edge of the transfer material 37 to retain it. The transfer material 37 receives corona discharge at the back side thereof, which is provided by the transfer corona discharger 41 of the image transfer unit 3. Thus, the developed image on the photosensitive member is transferred. In the case of a single color copy, the transfer material 37 is immediately separated from the transfer unit 39 by a separation pawl 42. In the case of multi-color reproduction, the gripper 40 of the image transfer unit 39 does not release the transfer material until all the images of the intended colors, i.e., two or three colors, have been transferred onto the transfer material 37, thus retaining the transfer material 37 with the separation pawl 42 not operated, either. In either of the cases, the transfer material 37 after the separation is conveyed by the conveying belt 43 to a heat type fixing roller 44, where the transferred image is heated and fixed on the transfer material 37. After the completion of the image fixing, the transfer material 37 is discharged to a discharge tray 45. On the other hand, the toner remaining on the surface of the photosensitive drum 21 after the completion of the image transfer operation is removed from the photosensitive drum 21 by the blade cleaner 31, so that the photosensitive drum 21 is prepared for the next copying cycle.

The non-magnetic toner for the yellow, magenta and cyan colors used with the developing units 361, 362 and 363, respectively have the following contents;

| | | |
|---|---|---|
| (1) | cyan toner | |
| | polyester resin | 94 parts |
| | phthalocyanine blue | 5 parts |
| | charge controlling agent | 1 part |
| (2) | magenta toner | |
| | polyester regin | 94 parts |
| | rhodamine lake pigment | 5 parts |
| | charge controlling agent | 1 part |
| (3) | yellow toner | |
| | polyester resin | 94 parts |
| | Hansa yellow | 5 parts |
| | charge controlling agent | 1 part |

The average particle size of the above respective toner particles was 10 microns. Each toner was mixed with iron particles which were magnetic particles. The magnetic brush was formed on the magnetic roller 8 in each of the developing unit, and the non-magnetic toner particles were applied to the developing roller 11 to develop the image. As will be appreciated, the color image forming apparatus using the developing devices according to the present invention, develops the image with non-magnetic toner, so that good color reproduction is obtained. In the conventional developing devices using magnetic toner, the toner is blackened by the magnetic material contained in the toner particle, so that the color of the toner is too dark to use the color reproduction.

As described in the foregoing, according to the present invention, the magnetic means and the developer carrying means are used so that the moving passage of the magnetic particles is made longer, with the result that the toner particles and the magnetic particles are sufficiently stirred, and that the non-magnetic toner particles are sufficiently triboelectrically charged due to the friction with the developer carrying means and the magnetic particles. Also, since the magnetic means is disposed below the developer carrying means the separation between the magnetic particles and the toner particles at the magnetic particle blocking member is made easier, so that the possible leakage of the magnetic particles at the blocking member is effectively prevented. Also, the pressure exerted by the magnetic particles to the surface of the developer carrying member can be increased, and therefore, the deterioration of the developer and the wearing of the developer carrying member surface can be prevented. For those reasons, the speed of the image formation is made higher. Furthermore, since the developing operation is as described above, using the non-magnetic toner particles, the developed image is free from a foggy background, and particularly, the reproduction of the color image is better, whereby it is applied to the color image forming apparatus with good advantages.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing a latent image formed on a latent image bearing member, comprising a rotatable developing means for developing the latent image formed on the latent image bearing member;

a magnetic means for forming a magnetic brush of a developer mixture containing toner particles and magnetic particles, and causing the magnetic brush to contact the magnetic brush with said developing means to transfer the developer mixture onto said developing means; and a magnetic particle blocking member, disposed in a region to which a magnetic field of said magnetic means extends and at a postion opposed to said developing means and downstream of the position where said developing means is contacted by the magnetic brush, wherein said magnetic means forming the magnetic field and said magnetic particle blocking member cooperate to cause the magnetic particles to fall away from said developing means with the aid of gravity and thus remove the magnetic particles from the developer mixture and wherein said magnetic particle blocking member regulates the thickness of a layer of the toner particles on said developing means downstream of said magnetic particle blocking member with respect to the direction of rotation of said developing means.

2. an apparatus according to claim 1, wherein said magnetic particle blocking member is of a magnetic material and wherein said magnetic means and said magnetic particle blocking member cooperate to confine the magnetic particles with the aid of the magnetic field.

3. An apparatus according to claim 1, wherein said magnetic means comprises a fixed magnet and a sleeve rotatable therearound.

4. An apparatus according to claim 1, wherein said developing means includes an iron roller.

5. An apparatus according to claim 1, wherein said magnetic means is disposed below said developing roller and wherein said blocking member has an end disposed above a horizontal plane passing through a center of said developer means.

6. An apparatus according to claim 1, wherein a developing bias voltage is applied to said developing means by a bias source and said bias source is effective to promote movement of the developer mixture from said magnetic means to said developing means.

7. An apparatus according to claim 1, wherein said developing apparatus is capable of effecting color-development in plural colors, and comprises a set of said developing units each for developing with a different one of the plural colors.

8. A developing apparatus for developing a latent image formed on a latent image bearing member, comprising:

a rotatable developing means for developing the latent image formed on the latent image bearing member;

a magnetic means for forming a magnetic brush of a developer mixture containing toner particles and magnetic particles, and for causing the magnetic brush to contact with said developing means to transfer the developer mixture onto said developing means; and a magnetic particle blocking member, disposed opposed to said developing means at a position downstream of the position where said developing means is contacted by the magnetic brush, for blocking the magnetic particles to form a coating of the toner particles on a surface of said developing means, wherein the coating of the toner particles is conveyed by the rotation of said developing means to a developing station where the latent image is developed with the conveyed toner particles; and wherein said developing means and said magnetic means are maintained at the same electric potential.

9. A developing apparatus for developing a latent image formed on a latent image bearing member, comprising:

magnetic means for forming a magnetic brush of a developer mixture containing developer particles and magnetic particles;

movable developer carrying means for developing the latent image formed on the latent image bearing member, said developer carrying means being contactable with the magnetic brush to receive the developer mixture;

magnetic field generating means fixedly provided in said developer carrying means; and a magnetic particle blocking member, disposed opposed to said developer carrying means at a position downstream of the position where said developer carrying means is contacted by the magnetic brush, for blocking the magnetic particles to form a coating of the developer particles on a surface of said developer carrying means, wherein the coating of the developer particles is conveyed by the movement of said developer carrying means to a developing station where the latent image is developed with the conveyed developer particles.

10. An apparatus according to claim 9, wherein said magnetic particle blocking member is of a magnetic material.

11. An apparatus according to claim 10, wherein said magnetic field generating means is provided with a magnetic pole disposed upstream of said magnetic particle blocking member with respect to the movement of said developer carrying means.

12. An apparatus according to claim 11, wherein said magnetic particle blocking member is inclined toward downstream with respect to the movement of said developer carrying means.

13. An apparatus according to claim 12, wherein an angle formed between said magnetic particle blocking member and a normal line to said developer carrying member passing through a free end of said developer particle blocking member, is not less than 0 degree and not more than 90 degrees.

14. An apparatus according to claim 11 wherein said developer carrying member is a sleeve and wherein the angle formed between a normal line to said developer carrying member passing through the free end of said magnetic particle blocking member and a line extending from the center of said sleeve and said magnetic pole is not less than 20 degrees.

15. An apparatus according to claim 10, wherein said magnetic particle blocking member and said developer carrying means are spaced by a clearance of 100–1000 microns.

16. An apparatus according to claim 10, wherein said magnetic particle blocking member and said developer carrying means are spaced by a clearance of 200–300 microns.

17. An apparatus according to claim 10, wherein said magnetic field generating means is provided with a magnetic pole for receiving the developer mixture onto said developer carrying means.

18. An apparatus according to claim 10, wherein said magnetic means includes a sleeve and a magnet provided therein and rotatable relative to said sleeve.

19. An apparatus according to claim 18, wherein said magnet is fixed and provided with a magnetic pole for forming a magnetic brush on said sleeve at a position where said sleeve is opposed to said developer carrying means.

20. An apparatus according to claim 19, wherein said magnetic field generating means is provided with a magnetic pole for receiving the developer mixture onto said developer carrying means, which magnetic pole is of the opposite polarity to that of said magnetic pole for forming the magnetic brush and is larger in magnetic flux density than said magnetic pole for forming the magnetic brush.

21. An apparatus according to claim 19, wherein said magnetic pole for forming the magnetic brush includes a plurality of magnetic pole elements of the same polarity to form a repelling magnetic field.

22. An apparatus according to claim 10, wherein said magnetic field generating means is provided with a conveying magnetic pole for conveying the magnetic particles which are leak by said magnetic particle blocking member.

23. An apparatus according to claim 10, wherein said developer carrying means includes a sleeve of a non-magnetic material.

24. An apparatus according to claim 23, wherein a developing bias voltage is applied to said sleeve.

25. An apparatus according to claim 24, wherein said developing bias voltage is an AC voltage.

26. An apparatus according to claim 25, wherein a DC voltage is superposed with said AC voltage.

27. An apparatus according to claim 24, wherein said sleeve and said magnetic means are maintained at the same electric potential.

28. An apparatus according to claim 24, wherein a bias voltage is applied between said sleeve and said magnetic means to promote movement of the mixture to said sleeve.

29. An apparatus according to claim 28, wherein said promoting bias voltage is variable.

30. An apparatus according to claim 23, wherein the developer particles on said sleeve are out of contact with the latent image bearing member at the developing station.

31. An apparatus according to claim 23, wherein said sleeve is of a flexible material, and the developer particles on said sleeve is contacted to the latent image bearing member at the developing station.

32. An apparatus according to claim 23, wherein a free end of said magnetic particle blocking member is below a horizontal line passing through the center of said sleeve.

33. An apparatus according to claim 10, wherein said magnetic particles have an average particle size of 30–200 microns.

34. An apparatus according to claim 33, wherein the developer particles have an average particle size of 4–20 microns.

35. An apparatus according to claim 34, wherein the developer mixture contains 2–70% by weight of the developer particles with respect to the magnetic particles.

36. An apparatus according to claim 10, wherein the developer particles are non-magnetic.

37. An apparatus according to claim 10, wherein said magnetic means is disposed below said developer carrying means.

38. An apparatus according to claim 10, further comprising a hopper for containing the developer particles to be supplied, a member, provided at an outlet of said hopper, for supplying the developer particles, means, provided in the developing device, for detecting developer particle content and means for actuating said supplying member in accordance with an output signal of said developer content detecting means.

39. A color image forming apparatus comprising:

a movable latent image bearing member for bearing an electrostatic latent image thereon;

means for forming an electrostatic latent image on said latent image bearing member;

a plurality of developing means for developing the latent image formed on said image bearing member, each said developing means including magnetic means for forming a magnetic brush of a developer mixture containing developer particles and magnetic particles; a movable developer carrying means for developing the latent image on said latent image bearing member, said developer carrying means being contactable with the magnetic brush to receive the developer mixture; a magnetic field generating means, fixedly provided in said developer carrying means, for applying magnetic force to the developer mixture on said developer carrying means and a magnetic particle blocking member, disposed opposed to said developer carrying means at a position downstream of the position where the developer carrying means is contacted by the magnetic brush, for blocking the magnetic particles to form a coating of the developer particles on a surface of said developer carrying means, wherein the coating of the developer particles is conveyed by the movement of said developer carrying means to a developing station where the latent image is developed with the conveyed developer particles.

40. An apparatus according to claim 39, wherein said blocking member is of a magnetic material forming a strong magnetic field with said magnetic field generating means, and is effective to confine the magnetic particles by the strong magnetic field.

41. An apparatus according to claim 39, wherein said plural developing means are for cyan, magenta and yellow color developers, respectively, and the toner layer on said developer carrying member is spaced from said latent image bearing member at a developing position where an alternating electric field is formed.

42. A developing apparatus for developing a latent image formed on a latent image bearing member with a developing unit, said developing unit comprising:

magnetic means for forming and conveying a magnetic brush of a developer mixture containing developer particles and magnetic particles;

rotatable developer carrying means for developing the latent image formed on the latent image bearing member, said developer carrying means being contactable with the magnetic brush to receive the developer mixture, wherein said developer is disposed above said magnetic means;

means, disposed opposed to said developer carrying means, to regulate a thickness of a developer layer formed on said developer carrying means; and means for rotating said magnetic means and said developer carrying means so that they move in opposite peripheral directions at a position where they are closely opposed;

wherein the magnetic particles are circulated along a circulation path by the movement thereof to said regulating means along said developer carrying means by the movement of said developer carrying means, by the movement thereof from said regulating means to said magnetic means under the influence of gravity, and by the movement thereof from said magnetic means to said developing means by the movement of said magnetic means, and wherein said regulating means is of magnetic material which confines the magnetic particles by a magnetic field formed with magnetic field generating means disposed in said developer carrying means.

43. A developing apparatus for developing a latent image formed on a latent image bearing member with a developing unit, said developing unit comprising:

magnetic means for forming and conveying a magnetic brush of a developer mixture containing developer particles and magnetic particles;

rotatable developer carrying means for developing the latent image formed on the latent image bearing member, said developer carrying means being contactable with the magnetic brush to receive the developer mixture, wherein said developer carrying means is disposed above said magnetic means;

means, disposed opposed to said developer carrying means, to regulate a thickness of a developer layer formed on said developer carrying means; and means for rotating said magnetic means and said developer carrying means so that they move in opposite peripheral directions at a position where they are closely opposed;

wherein the magnetic particles are circulated along a circulation path by the movement thereof to said regulating means along said developer carrying means by the movement of said developer carrying means, by the movement thereof from said regulating means to said magnetic means under the influence of gravity, and by the movement thereof from said magnetic means to said developing means by the movement of said magnetic means, and wherein said regulating means is disposed in the magnetic field formed by said magnetic means and is effective to remove the magnetic particles from the developer mixture.

44. A developing apparatus for developing a latent image formed on a latent image bearing member with a developing unit, said developing unit comprising:

magnetic means for forming and conveying a magnetic brush of a developer mixture containing developer particles and magnetic particles;

rotatable developer carrying means for developing the latent image formed on the latent image bearing member, said developer carrying means being contactable with the magnetic brush to receive the developer mixture, wherein said developer carrying means is disposed above said magnetic means;

stationary magnetic field generating means within said developer carrying means to promote the circulation of the developer mixture;

means, disposed opposed to said developer carrying means, to regulate a thickness of a developer layer formed on said developer carrying means; and means for rotating said magnetic means and said developer carrying means so that they move in opposite peripheral directions at a position where they are closely opposed;

wherein the magnetic particles are circulated along a circulation path by the movement thereof to said regulating means along said developer carrying means by the movement of said developer carrying means, by the movement thereof from said regulating means to said magnetic means under the influence of gravity, and by the movement thereof from said magnetic means to said developing means by the movement of said magnetic means.

45. A developing apparatus for developing a latent image formed on a latent image bearing member, comprising:

a rotatable developing means for developing the latent image formed on the latent image bearing member, said developing means including a magnetic member; and a magnetic means for forming a magnetic brush of a developer mixture containing toner particles and magnetic particles, said magnetic means including a non-magnetic sleeve and a magnetic field generating member which forms a magnetic field between itself and said magnetic member and causes said magnetic brush to contact said rotatable developing means.

* * * * *

UNITED STATES PATENT AND TRADEMARK OFFICE

CERTIFICATE OF CORRECTION

PATENT NO. : 4,669,852

DATED : June 2, 1987

INVENTOR(S) : HATSUO TAJIMA, ET AL.

It is certified that error appears in the above-identified patent and that said Letters Patent is hereby corrected as shown below:

AT [56] UNDER REFERENCES CITED/U.S. PATENT DOCUMENTS

| | | | |
|---|---|---|---|
| --3,929,098 | 12/1975 | Liebman | 118/653 |
| 4,383,497 | 5/1983 | Tajima | 355/3DDX-- |

should be inserted.

AT [56] UNDER REFERENCES CITED

--FOREIGN PATENT DOCUMENTS

| | | | |
|---|---|---|---|
| 54-116240 | 9/1979 | Japan | 355/3DD |
| 56-69669 | 6/1981 | Japan | 355/3DD-- |

should be inserted.

COLUMN 1

Line 50, "v.s." should read --vs.--.

COLUMN 5

Line 14, "embodiments," should read --embodiment,--.
Line 54, "be" should be deleted.

COLUMN 6

Line 57, "is" should read --are--.

COLUMN 8

Line 56, "wearing, of" should read --wearing of--.
Line 58, "of the" should read --of--.

UNITED STATES PATENT AND TRADEMARK OFFICE

CERTIFICATE OF CORRECTION

PATENT NO. : 4,669,852

DATED : June 2, 1987

INVENTOR(S) : HATSUO TAJIMA, ET AL.

It is certified that error appears in the above-identified patent and that said Letters Patent is hereby corrected as shown below:

COLUMN 9

Line 46, "registance" should read --resistance--.

COLUMN 10

Line 22, "250V" should read --+250V--.
Line 63, "avoided" should be deleted.

COLUMN 11

Line 20, "81," should read --281,--.
Line 53, "3." should read --39.--.

COLUMN 12

Line 16, "regin" should read --resin--.

COLUMN 13

Line 6, "prising" should read --prising:--.
Line 13, "the magnetic brush with" should be deleted.
Line 32, "an" should read --An--.
Lines 44-45, "roller" should read --means--.
Line 54, "1" should read --42--.

COLUMN 14

Line 58, "11 wherein" should read --11, wherein--.

UNITED STATES PATENT AND TRADEMARK OFFICE

CERTIFICATE OF CORRECTION

PATENT NO. : 4,669,852

DATED : June 2, 1987

INVENTOR(S) : HATSUO TAJIMA, ET AL.

It is certified that error appears in the above-identified patent and that said Letters Patent is hereby corrected as shown below:

COLUMN 15

Line 33, "are" should be deleted.
Line 49, "the mixture" should read --the developer mixture--.
Line 60, "is" should read --are--.

Signed and Sealed this

First Day of March, 1988

*Attest:*

*Attesting Officer*

DONALD J. QUIGG

*Commissioner of Patents and Trademarks*